US007238130B1

(12) United States Patent
Heald et al.

(10) Patent No.: US 7,238,130 B1
(45) **Date of Patent: *Jul. 3, 2007**

(54) HANDLE COLLAR FOR A BAT

(75) Inventors: Jess H. Heald, Tullahoma, TN (US); Jared J. Smalley, Jr., Tullahoma, TN (US); Arthur C. P. Chou, Fenton, MO (US)

(73) Assignee: Rawlings Sporting Goods Company, Inc., St. Louis, MI (US)

( * ) Notice: Subject to any disclaimer, the term of this patent is extended or adjusted under 35 U.S.C. 154(b) by 31 days.

This patent is subject to a terminal disclaimer.

(21) Appl. No.: 11/069,915

(22) Filed: Mar. 1, 2005

(51) Int. Cl.
*A63B 59/06* (2006.01)

(52) U.S. Cl. ..... 473/568

(58) Field of Classification Search ..... 473/398–303, 473/564–568, 551, 552, 519, 520, 457; 16/431; 74/551.9
See application file for complete search history.

(56) References Cited

U.S. PATENT DOCUMENTS

| | | | | |
|---|---|---|---|---|
| 610,471 | A * | 9/1898 | Cavanagh | 74/551.9 |
| 1,290,716 | A * | 1/1919 | Cline | 74/551.9 |
| 1,777,822 | A * | 10/1930 | Barrett | 473/298 |
| 3,972,528 | A * | 8/1976 | McCracken et al. | 473/566 |
| 5,011,145 | A | 4/1991 | Bartkowicz | 273/72 |
| 5,452,889 | A | 9/1995 | Lewinski et al. | 273/72 |
| 5,465,967 | A | 11/1995 | Boeckenhaupt | 273/162 |
| 5,577,722 | A | 11/1996 | Glassberg | 273/26 |
| 6,234,924 | B1 | 5/2001 | Washburn, Jr. | 473/568 |
| 6,406,387 | B1 | 6/2002 | Ryan | 473/457 |
| 6,449,803 | B1 * | 9/2002 | McConchie | 16/431 |
| 6,485,382 | B1 | 11/2002 | Chen | 473/566 |
| 6,821,218 | B2 | 11/2004 | Byrne et al. | 473/568 |

FOREIGN PATENT DOCUMENTS

WO WO9311835 A1 * 6/1993

* cited by examiner

*Primary Examiner*—Mark S. Graham
(74) *Attorney, Agent, or Firm*—Waddey & Patterson, PC; Phillip E. Walker

(57) ABSTRACT

A collar for a bat. The bat includes a barrel, a taper extending from the barrel, and a handle extending from the taper opposite the barrel. The handle includes a knob and a grip. The collar is slideably positioned on the grip between the knob and the taper to secure the grip to the handle. The collar includes a circumferential wall, a plurality of securing members positioned on the circumferential wall to engage the grip, and the collar is slideably preferably positioned on the handle between the grip and the taper. The securing members removably secure the collar to the grip and in turn removably secure the grip to the handle.

11 Claims, 5 Drawing Sheets

FIG. 5
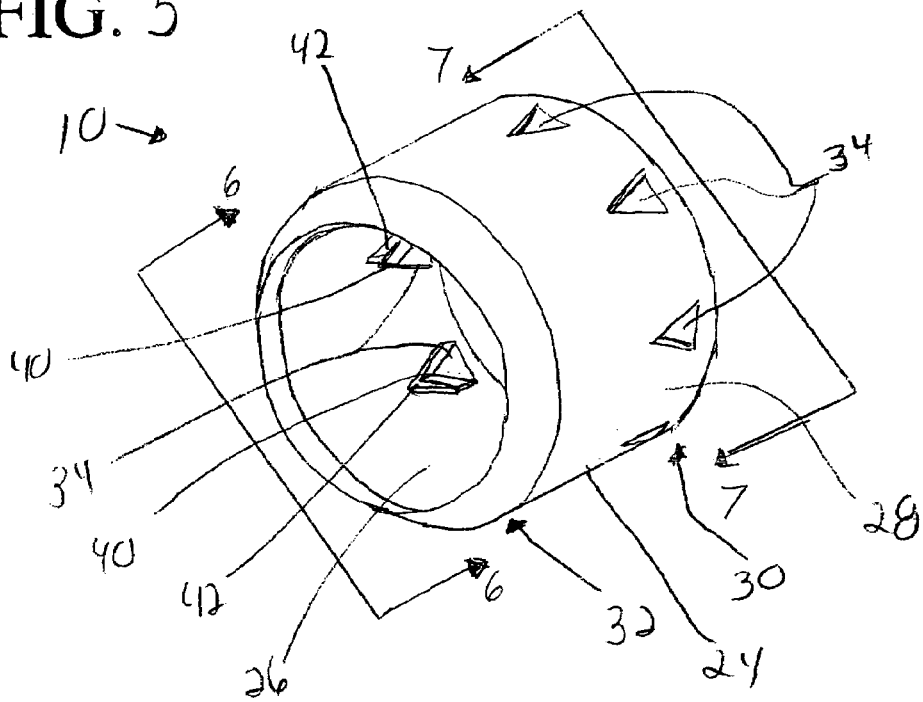
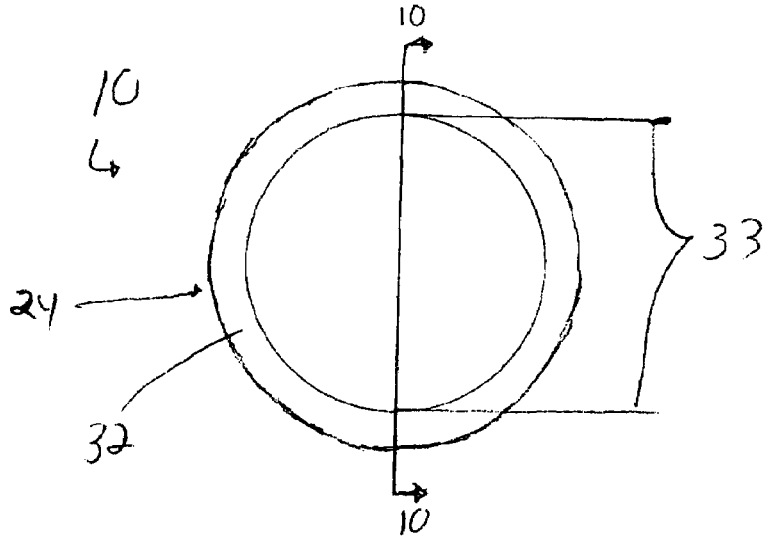
FIG. 6

FIG. 7
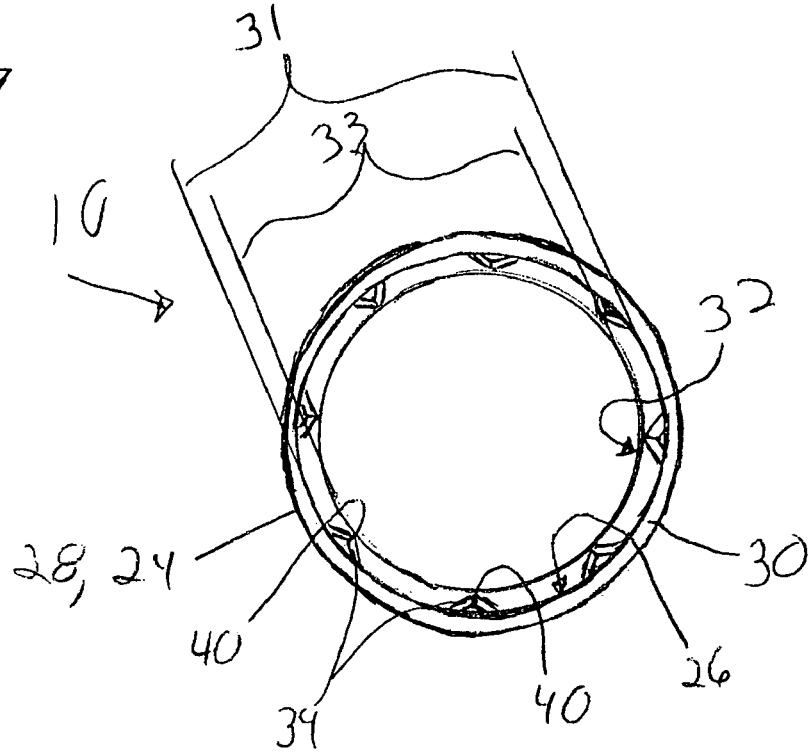
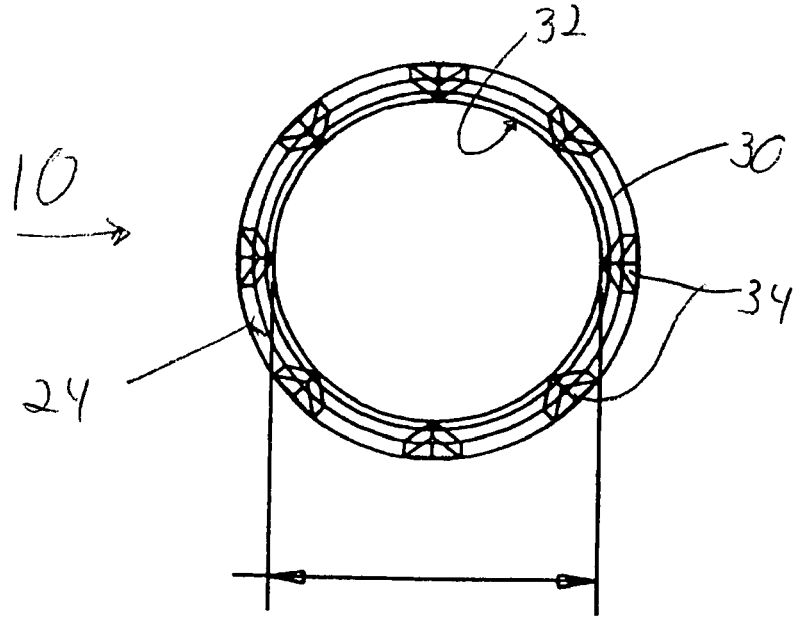
FIG. 8

HANDLE COLLAR FOR A BAT

BACKGROUND OF THE INVENTION

The present invention relates generally to baseball and softball bats. More specifically, the present invention relates to a collar used on the handle of a bat.

It will be appreciated by those skilled in the art that numerous prior art attempts have been made to improve a bat and its functional characteristics. These improvements range from various materials used in the construction of the bat to various design configurations and components of the bat.

Specifically, there have been prior art attempts to improve the handle portion of the bat, including attempts to improve the components that comprise the handle and the grip portion of the handle. For example, U.S. Pat. Nos. 5,452,889 and 5,465,967 disclose two grips used in association with bats that have variable weight capabilities using adjustable mass within the hollow portion of the handle.

U.S. Pat. No. 5,011,145 discloses a baseball bat having multiple grips, the upper grip permitting rotation about the inner grip in an effort to aid hitting a ball with that bat.

U.S. Pat. No. 3,972,528 discloses a friction grip used on the handles of bats having a permanent tacky feel that is respondent to heat and perspiration of a user of the bat where the grip has a plastic film at the end.

U.S. Pat. No. 5,577,722 discloses a bat grip device having a pair of gripping elements individually positionable upon the bat and having specific hand and finger shaped contours.

U.S. Pat. No. 6,234,924 discloses an artificial bat end device for temporarily adjusting the length of the bat by adding ring layers having a thickness sufficient to simulate the butt end of a bat.

U.S. Pat. No. 6,406,387 discloses a baseball practice bat having a slideable handle portion and finger locator portions molded into the handles to attempt to instruct a user in how to better hit a ball with the practice bat.

U.S. Pat. No. 6,821,218 discloses a ball bat with an inflatable grip using an inflatable tubular sleeve accepting the handle portion of the bat and allowing air to be pumped into and released from the sleeve allowing a batter to selectively pressurize the rigidity and size of the grip.

These prior art patents fail to appreciate a need to secure a standard grip to the handle portion of the bat. Currently, it is common practice to use tape in an effort to adhere the end of the grip to a handle of the bat. During the normal course of use of a bat, the traditional tape securement between the grip and the handle can experience wear and tear. For example, the tape can lose its adhesion properties and the collar can be compromised or cut by abrasions, such as rocks and sand on the playing field. Additionally, if the user of the bat decides to replace the grip, the resident glue from the tape can remain on the handle and become an unsightly mess and compromise the replacement grip, especially if the replacement grip is not of the same size as the original grip. Also, it can be very unsightly to have an expensive bat having a piece of black electric tape used to hold a portion of the bat to itself.

What is needed then is an esthetically pleasing collar used to secure the grip of a bat to the handle.

BRIEF SUMMARY OF THE INVENTION

Disclosed herein is a collar for a bat. The bat includes a barrel, a taper extending from the barrel, and a handle extending from the taper opposite the barrel. The handle includes a knob and a grip. The collar is slideably positioned on the grip between the knob and the taper to secure the grip to the handle. The collar includes a circumferential wall, a plurality of securing members positioned on the circumferential wall to engage the grip, and the collar is slideably preferably positioned on the handle between the grip and the taper. The securing members removeably secure the collar to the grip and in turn removeably secure the grip to the handle.

The circumferential wall includes a first end and a reduced end where each end includes an internal diameter. The internal diameter of the reduced end is smaller than the internal diameter of the first end. This reduction allows the reduced end to closely correspond with the circumference of the handle in order to removeably secure the grip to the handle. Additionally, the circumferential wall includes an internal circumference and an external circumference wherein the plurality of the securing members are positioned on the internal circumference. Each securing member includes a grasping location, or grasping point, positioned to removeably secure the collar to the grip.

Once the securing members engage the grip they are positioned, in relation to the collar and the grip, to restrict axial deflection of the collar with respect to the handle and the grip. As such, the securing members facilitate the retention of the collar at the end of the grip and the securement of the grip to the handle at that end location.

In a preferred embodiment the circumferential wall and securing members are composed of metal. Alternately, the collar can be composed of plastic. Additionally, a plurality of openings are positioned in the circumferential wall substantially aligned with the securing members. In a most preferred embodiment the securing members are formed by partially cutting out, or stamping, those securing members from the circumferential wall. The base of the securing members are left attached to the circumferential wall such that the securing members depend from the circumferential wall and are an integral part of the circumferential wall.

The collar is positioned on the grip between the knob of the handle and the taper portion of the bat. The grip of the bat includes a distal end spaced from the knob and the collar engages this distal end, and preferably covers the distal end. The distal end of the grip includes an external diameter and the tapered end of the collar has an internal diameter that is less than the external diameter of the distal end of the grip. This allows the collar to slide down to, but not completely past, the distal end of the grip.

It is therefore a general object of the present invention to provide a collar for a bat.

Another object of the present invention is to removeably secure the grip of a bat to the handle of a bat.

Still another object of the present invention is to provide a collar that is axially slideable along the handle of a bat.

Another object of the present invention is to provide a collar for a bat having securing locations used to engage the collar to the grip and handle of the bat.

Yet another object of the present invention is to provide an aesthetic ring transitioning the grip of a bat to the exposed handle of the bat.

Other and further objects, features and advantages of the present invention will be readily apparent to those skilled in the art upon reading of the following disclosure when taken in conjunction with the accompanying drawings.

BRIEF DESCRIPTION OF THE SEVERAL VIEWS OF THE DRAWINGS

FIG. 2 shows the collar engaging the ends of the grip.

FIG. 3 shows the collar transitioned towards the taper of the bat.

FIG. 4 shows the collar moved towards the taper of the bat.

FIG. 5 is a perspective view of an embodiment of the collar made in accordance with the current disclosure.

FIG. 6 is an end view taken along line 6-6 of FIG. 5.

FIG. 7 is an end view taken along line 7-7 of FIG. 5.

FIG. 8 is a phantom end view of the collar shown in FIG. 5.

DETAILED DESCRIPTION OF THE INVENTION

Figure 1:
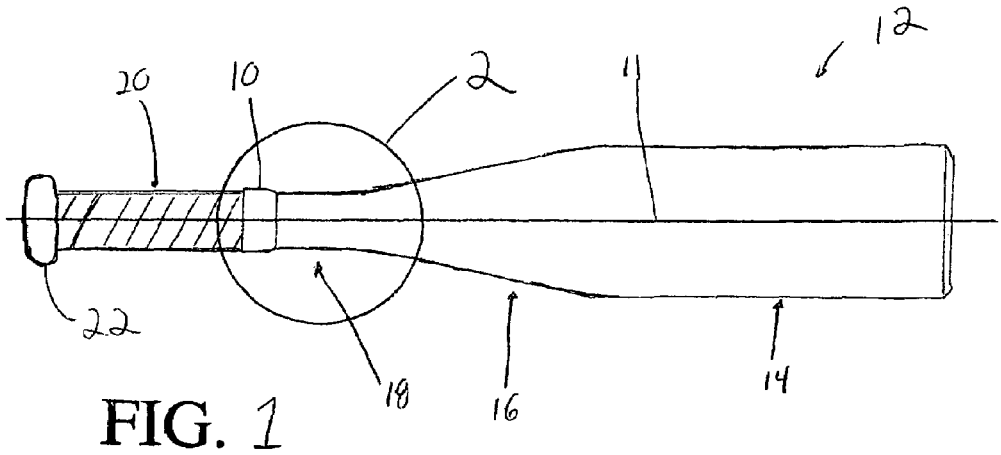
FIG. 1 is a side view of a bat made in accordance with the current disclosure.
Figure 2:
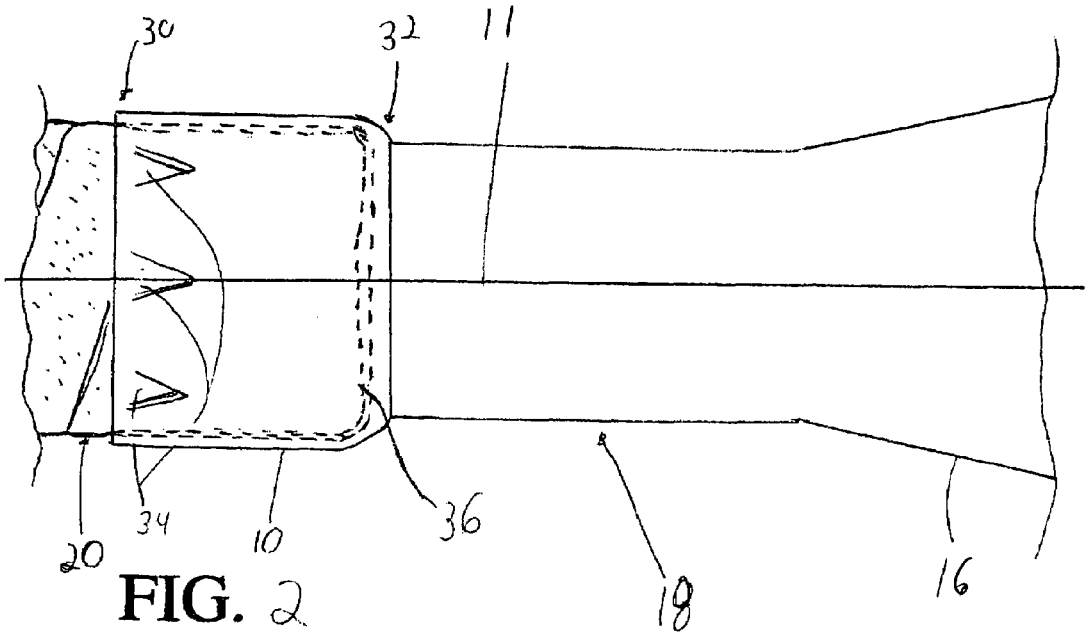
FIG. 2 is a detailed view of the area indicated by the Numeral 2 in FIG. 1.
Figure 3:
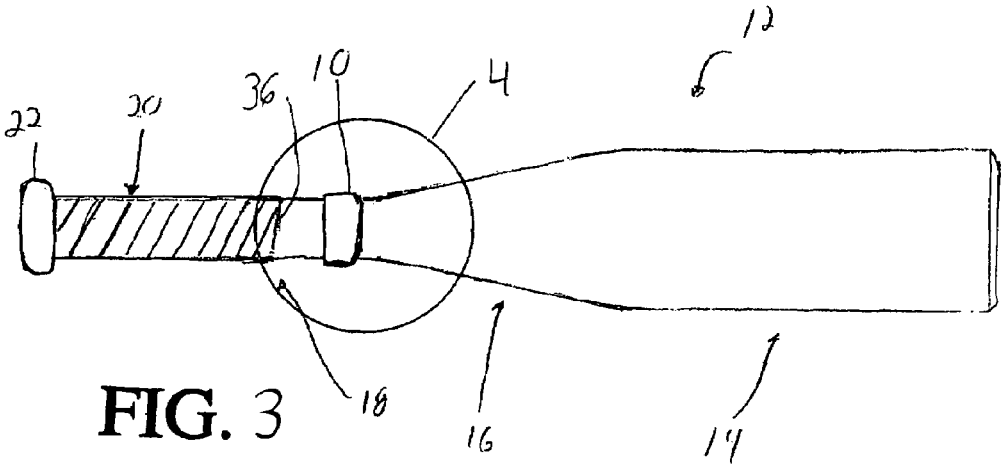
FIG. 3 is a side view similar to FIG. 1.
Figure 4:
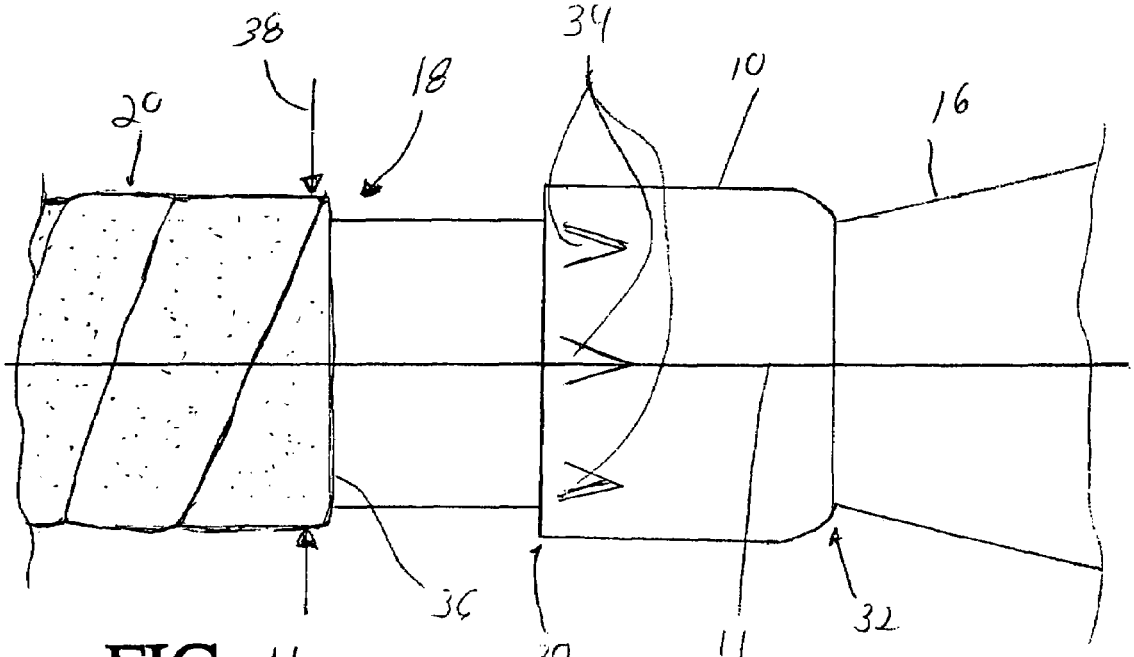
FIG. 4 is a detailed view of the area indicated as 4 in FIG. 3.
Figure 10:
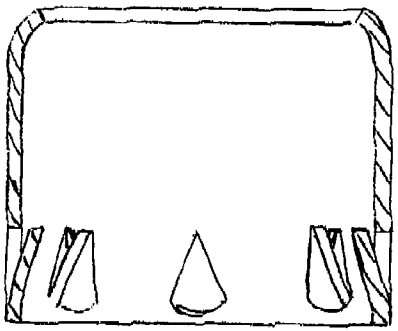
FIG. 10 is a side cross-sectional view taken along line 10-10 of FIG. 6.
Figure 9:
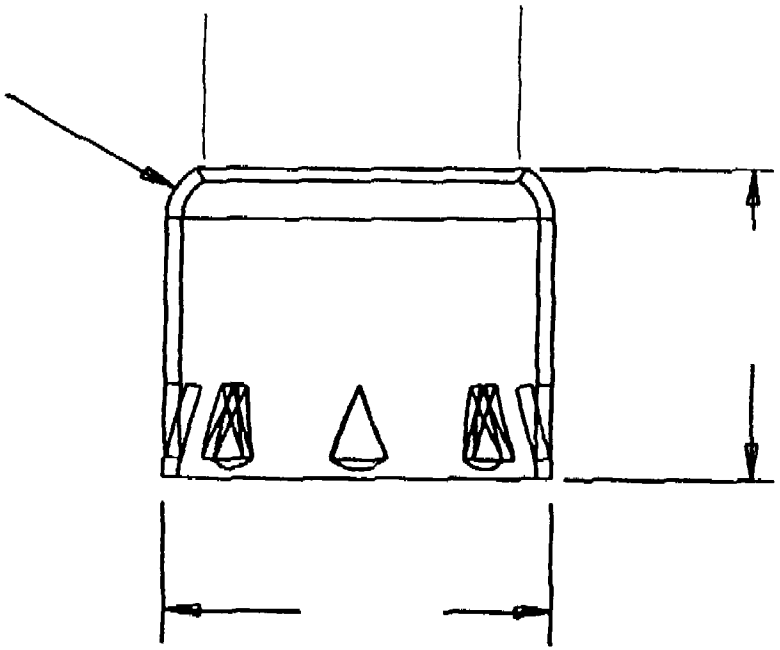
FIG. 9 is a side phantom view of the collar shown in FIG. 5.

Referring generally now to FIGS. 1-10, a collar is generally shown and designated by the numeral 10. The collar 10, which can also be described as a ring 10, is used in conjunction with a bat 12, which is preferably a baseball or softball bat 12. The bat 12 includes a barrel 14, a taper 16, and a handle 18. The taper 16 extends from the barrel 14 and the handle 18 extends from the taper 16 opposite the barrel 14.

The handle 18 includes a knob 22 positioned opposite the taper 16. The handle 18 also includes a grip 20 which can be any grip 20 known in the art. For example, the grip 20 can be made of a material wrapped around the handle 18 or a material slipped over the handle 18. The grip 20 can be made of leather, polymers, rubber, or other materials known in the art.

The collar 10 comprises a circumferential wall 24 having an internal circumference 26 and an external circumference 28. Additionally, the circumferential wall 24 includes a first end 30 and a reduced end 32, which can be described as a tapered end 32. The collar 10 also includes at least one securing member 34 positioned on the circumferential wall 24 to engage the grip 20. The collar 10 is slideably positioned on the handle 18 between the grip 20 and the taper 16 to secureably and removeably engage the grip 20 to the handle 18.

Preferably, the circumferential wall and securing members are all composed of metal. The at least one securing member 34 can be a plurality of securing members 34 that removeably secure the collar 10 to the grip 20. Additionally, the collar 10 can snugly fit around the grip 20 and handle 18 to secure the grip 20 to the handle 18. For example, the internal diameter 31 of the first end 30 can be larger than the internal diameter 33 of the reduced end 32. The discrepancies in internal diameters 31 and 33 allow the collar 10 to slide along the grip 20 in a direction parallel with the axis 11 of the bat 12.

The distal end 36 of the grip 20 includes an external diameter 38 that is less than the internal diameter 31 of the first end 30. Preferably this is a snug fit, or a frictional fit, between the external diameter 38 of the distal end 36 and the internal diameter 31 of the first end 30.

The collar 10 can traverse the handle 18 until the internal diameter 33 of the reduced end 32 engages the distal end 36 of the grip 20. The reduced end 32 is designed such that it resists passing over the distal end 36 of the grip 20 and has a partially snug fit with, or is in close proximity to, the portion of the handle 18 between the grip 20 and taper 16.

The securing members 34, which can also be described as securing elements 34, can be positioned on the internal circumference 26 of the circumferential wall 24. As such, the securing members 34 can depend from the internal circumference 26 of the circumferential wall 24. Each securing member 34 includes a grasping location 40 positioned to removeably secure the collar 10 to the grip 20. The grasping locations 40 are positioned to engage the grip 22 when the collar 10 is axially deflected towards the taper 16. These grasping locations 40 are also designed to refrain from securely engaging the grip 20 when the collar 10 is axially deflected towards the knob 22 when the collar 10 engages the grip 20. The grasping locations 40 are shown as having pointed edges, however they can have blunt or dull edges and still maintain the inventive nature of this disclosure.

The collar 10 can further include at least one opening 42 positioned in the circumferential wall 24 substantially aligned with the at least one securing member 34. In a preferred embodiment, the securing members 34 are created by pressing or pushing a portion of the material comprising the circumferential wall 24 inward to create the securing members 34 and openings 42. Alternatively, the securing members 34 can be material added to the internal circumference 26 of the circumferential wall 24.

The collar 10 is positioned on the grip 20 between the knob 22 and the taper 16 to secure the grip 20 to the handle 18. The collar 10 can engage the distal end 36 of the grip 20 and preferably covers the distal end 36 of the grip 20 when the collar 10 is slid parallel to the axis 11 of the bat 12 in a direction that is toward the knob 22.

As best illustrated in FIGS. 1-4, the collar 10 can be slid along the handle 18 to encompass the grip 20. The distal end 36 of the grip 20 can slide within the collar 10 up to the tapered end 32 to engage the tapered end 32 and restrict further transverse movement of the collar 10 parallel to the axis 11 of the bat 12 in the direction of the knob 22.

Thus, although there have been described particular embodiments of the present invention of a new and useful HANDLE COLLAR FOR A BAT, it is not intended that such references be construed as limitations upon the scope of this invention except as set forth in the following claims.

What is claimed is:

1. A collar for a bat having a barrel, a taper, a knob, and a handle, the handle having a grip including a distal end opposite the knob, the collar comprising a circumferential wall having a substantially constant diameter and including a first end and a reduced end;

at least one securing member positioned on the circumferential wall and bendable to selectively engage, disengage, and removably secure the collar to the grip;

the collar slideably positionable on the handle between the grip and the taper; and the reduced end positionable to directly engage the distal end of the grip and slidably engage the bat.

2. The collar of claim 1, further including at least one opening positioned in the circumferential wall.

3. The collar of claim 2, wherein the at least one opening is substantially aligned with the at least one securing member.

4. The collar of claim 1, wherein the circumferential wall and the at least one securing member are composed of metal.

5. The collar of claim 1, the circumferential wall further including an internal circumference and an external circumference and a plurality of securing members are positioned on the internal circumference.

6. The collar of claim 1, wherein the first and reduced ends each include an internal diameter and the internal diameter of the reduced end is smaller than the internal diameter of the first end.

7. The collar of claim 1, wherein the ring is composed of metal.

8. The collar of claim 1, wherein the ring is composed of plastic.

9. A collar for a bat having a barrel, a taper and a handle, the handle having a grip including a distal end opposite the knob, the collar comprising a circumferential wall having a substantially constant diameter, a first end, and a tapered end spaced from the first end, the tapered end positioned to directly engage the distal end of the grip and slidably engage the bat;

a plurality of securing members internally depending from the circumferential wall to removably secure the collar to the grip, each securing member including a grasping location positioned to removably secure the collar to the grip, each grasping location positioned to allow movement of the collar toward the knob and restriction movement of the collar toward the taper;

a plurality of openings positioned in the circumference wall, each opening substantially aligned with one of the securing members to allow movement of said securing member and having at least one point positioned toward the tapered end; and the collar slideably positionable on the handle between the grip and the taper.

10. A bat comprising:

a barrel;

a taper extending from the barrel;

a handle extending from the taper opposite the barrel and including a knob and a grip, the grip including a distal end spaced from the knob; and a collar positioned on the grip between the knob and the taper to removably secure the grip to the handle, the collar directly engaging the distal end of the grip and slidably engaging the handle, the collar including:

at least one securing member internally depending from the circumferential wall, each securing member including a grasping location positioned to removably secure the collar to the grip, each grasping location positioned to allow movement of the collar toward the knob and restrict movement of the collar toward the taper; and a plurality of openings positioned in the circumference wall, each opening substantially aligned with one of the securing members to allow movement of said securing member and having at least one point positioned toward the tapered end.

11. The bat of claim 10, wherein the collar covers the distal end.

* * * * *